US006257943B1

(12) United States Patent
Peterson

(10) Patent No.: US 6,257,943 B1
(45) Date of Patent: Jul. 10, 2001

(54) INFLATABLE VEHICLE

(75) Inventor: Leroy L. Peterson, Omaha, NE (US)

(73) Assignee: Sportsstuff, Inc., Omaha, NE (US)

( * ) Notice: Subject to any disclaimer, the term of this patent is extended or adjusted under 35 U.S.C. 154(b) by 0 days.

(21) Appl. No.: 09/574,194

(22) Filed: May 18, 2000

(51) Int. Cl.[7] ..... B63C 9/08
(52) U.S. Cl. ..... 441/129; 114/345
(58) Field of Search ..... 441/65, 66, 67, 441/79, 129, 130; 114/126, 345, 346; D21/803, 809; 472/128, 129

(56) References Cited

U.S. PATENT DOCUMENTS

D. 322,301 * 12/1991 Harris ..... D12/237
D. 393,683 * 4/1998 Song et al. ..... D21/237
D. 394,095 * 5/1998 Kuan ..... D21/237
D. 428,096 * 7/2000 Peterson ..... D12/803
D. 435,826 * 1/2001 Peterson ..... D12/316
D. 436,073 * 1/2001 Peterson ..... D12/316
2,999,253 * 9/1961 Lewis ..... 441/65
5,713,773 * 2/1998 Churchill ..... 441/66

FOREIGN PATENT DOCUMENTS

44965 * 10/1888 (DE) ..... 441/131
2226282 * 6/1990 (GB) ..... 114/348
406247380 * 9/1994 (JP) ..... 114/345

* cited by examiner

*Primary Examiner*—S. Joseph Morano
*Assistant Examiner*—Ajay Vasudeva
(74) *Attorney, Agent, or Firm*—Henderson & Sturm LLP

(57) ABSTRACT

An inflatable recreational vehicle including an inflatable body member and a pair of passenger cockpits defined by a pair of elongated fore-and-aft directed laterally spaced recesses disposed inwardly from the peripheral edge of the body member. A first inflatable backrest is disposed adjacent one of the cockpits between the cockpit and the rear of the body member. A second inflatable backrest is positioned next to the other of the cockpits between the cockpit and the front of the body member. The arrangement of the cockpits and the backrests allows two passengers to be seated laterally spaced from and facing each other.

8 Claims, 2 Drawing Sheets

INFLATABLE VEHICLE

BACKGROUND OF THE INVENTION

1. Field of the Invention

The present invention relates to the field of recreational vehicles, and more particularly to an inflatable recreational vehicle.

2. Description of Related Art

The prior art is replete with myriad and diverse inflatable recreational vehicles.

While all of the aforementioned prior art constructions are more than adequate for the basic purpose and function for which they have been specifically designed, they are uniformly deficient with respect to their failure to provide a simple, efficient, and practical inflatable vehicle that allows two passengers to be seated in spaced cockpits while facing each other.

As a consequence of the foregoing situation, there has existed a longstanding need for a new and improved inflatable vehicle, and the provision of such a construction is a stated objective of the present invention.

BRIEF SUMMARY OF THE INVENTION

Briefly stated, the present invention provides an inflatable recreational vehicle including an inflatable body member and a pair of passenger cockpits defined by a pair of elongated fore-and-aft directed laterally spaced recesses disposed inwardly from the peripheral edge of the body member. A first inflatable backrest is disposed adjacent one of the cockpits between the cockpit and the rear of the body member. A second inflatable backrest is positioned next to the other of the cockpits between the cockpit and the front of the body member. The arrangement of the cockpits and the backrests allows two passengers to be seated laterally spaced from and facing each other.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
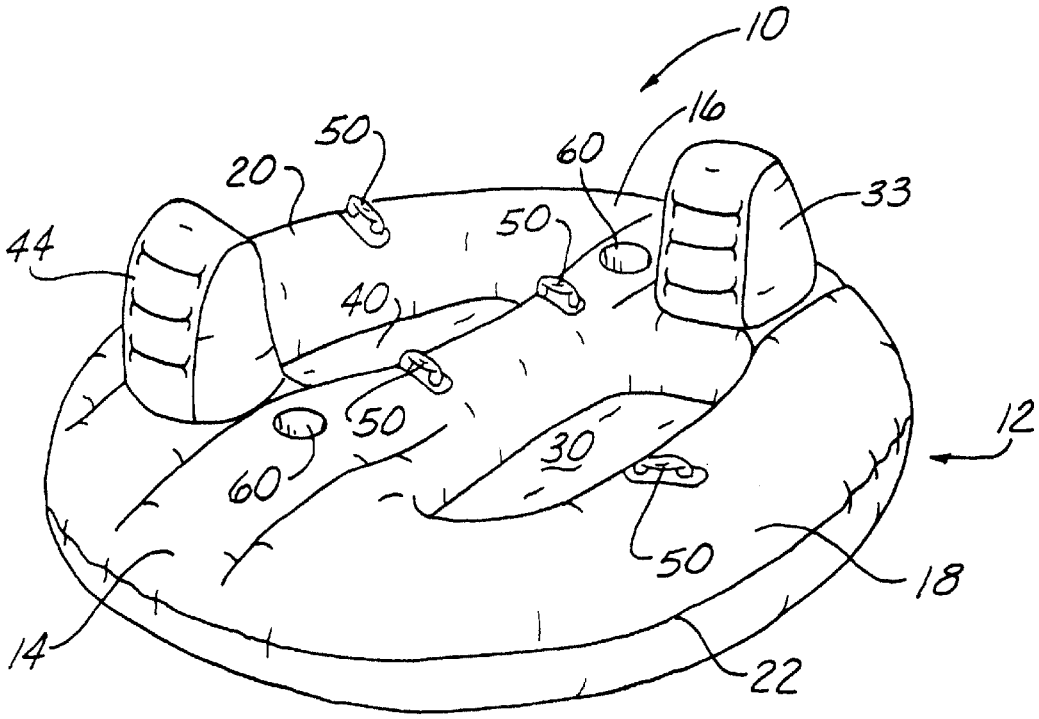
FIG. 1 is a perspective view of the inflatable recreational vehicle of the present invention.
Figure 2:
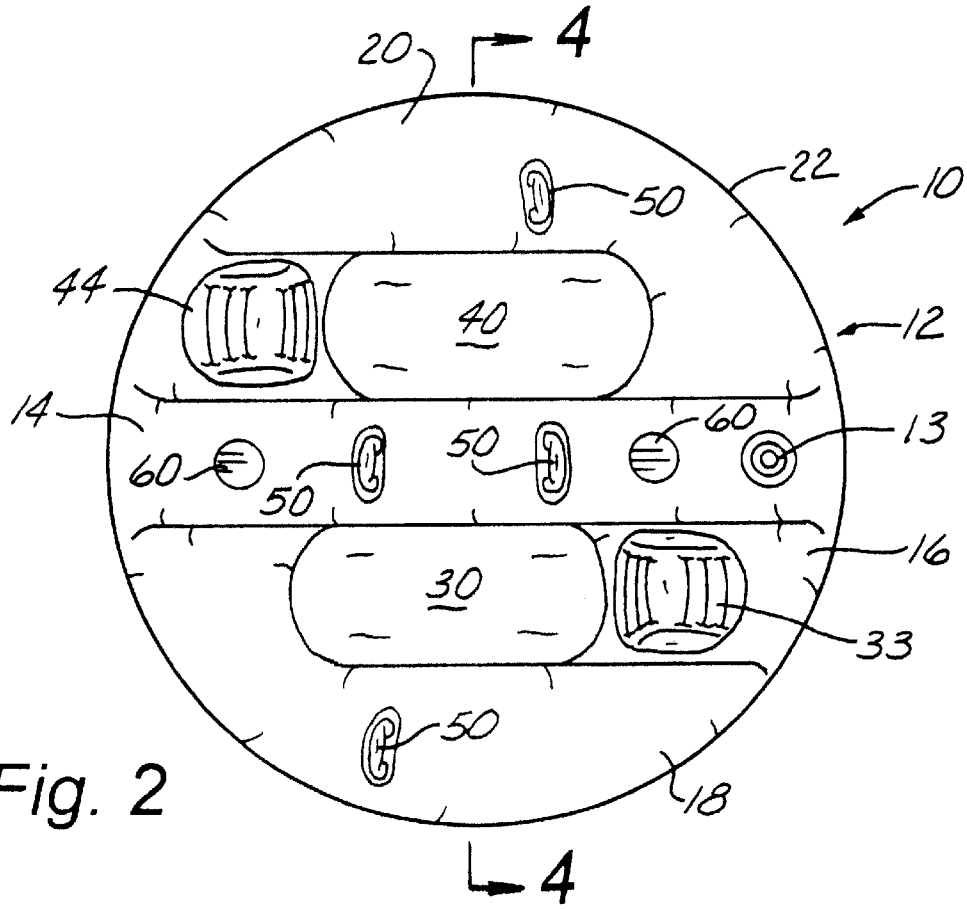
FIG. 2 is a top plan view thereof.
Figure 3:
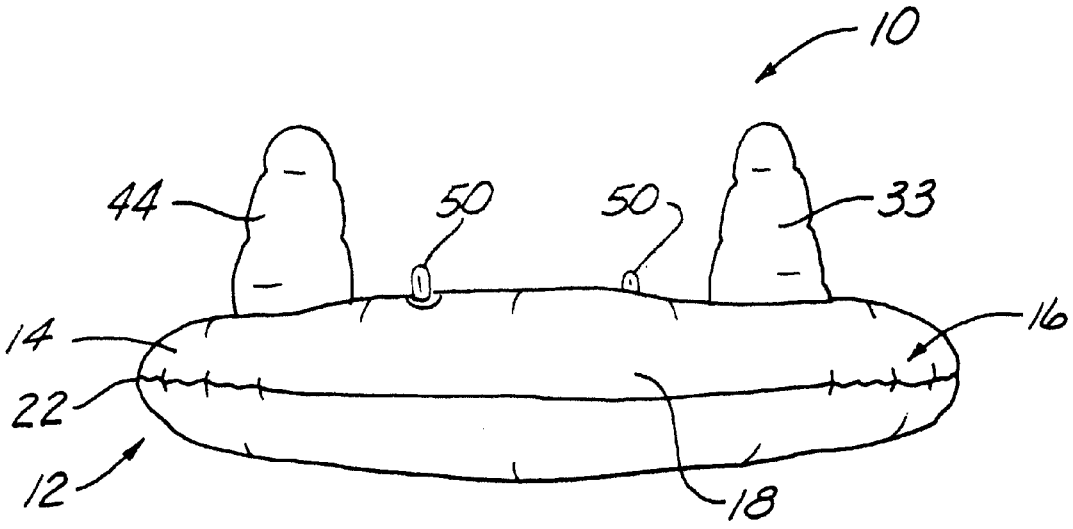
FIG. 3 is a side elevational view thereof.
Figure 4:
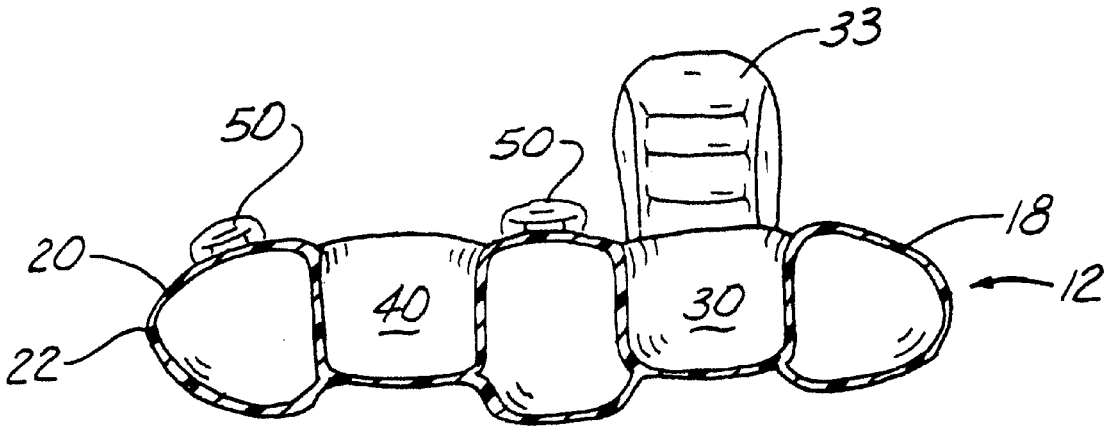
FIG. 4 is a sectional view taken along line 4—4 of FIG. 2.

As can be seen by reference to the drawings, and in particular to FIG. 1, the inflatable vehicle that forms the basis of the present invention is designated generally by the reference number 10. The inflatable vehicle 10 includes a body member 12 inflated through valve 13 and having a front 14, a rear 16, lateral sides 18, 20 and a peripheral edge 22. A pair of elongated fore-and-aft directed, laterally spaced recesses in the body member 12 define a pair of passenger cockpits 30 and 40.

A first inflatable backrest 33 is disposed next to one of the cockpits 30 between the cockpit 30 and the rear 16 of the body member 12. A second inflatable backrest 44 is disposed next to the other cockpit 40 between the cockpit 40 and the front 14 of the body member 12. The backrests 33, 44 may be inflated with the body member 12 through inflation valve 13, or if desired, they could be separately inflatable through inflation valves (not shown) in the backrests 33, 44.

A pair of hand grips 50 are disposed at the sides of each of the cockpits 30 and 40 and a pair of beverage holders 60 are positioned between the cockpits 30 and 40.

The arrangement of the cockpits 30 and 40 with their backrests 33 and 44 allows two passengers to be seated laterally spaced from and facing each other.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An inflatable vehicle, comprising:

an inflatable body member including a front, a rear, lateral sides, and a peripheral edge;

a pair of passenger cockpits defined by a pair of elongated fore-and-aft directed, laterally spaced recesses in the body member disposed inwardly from the peripheral edge;

a first backrest disposed adjacent one of the pair of cockpits and disposed between the one cockpit and the rear of the body member; and a second backrest disposed adjacent another of the pair of cockpits and disposed between the other cockpit and the front of the body member.

2. The inflatable vehicle of claim 1 wherein the first and second backrests are inflatable.

3. The inflatable vehicle of claim 2 further including a pair of hand grips disposed on the body member adjacent each of the pair of passenger cockpits.

4. The inflatable vehicle of claim 3 further including a pair of beverage holders disposed on the body member between the pair of passenger cockpits.

5. The inflatable vehicle of claim 2 further including a pair of beverage holders disposed on the body member between the pair of passenger cockpits.

6. The inflatable vehicle of claim 1 further including a pair of hand grips disposed on the body member adjacent each of the pair of passenger cockpits.

7. The inflatable vehicle of claim 6 further including a pair of beverage holders disposed on the body member between the pair of passenger cockpits.

8. The inflatable vehicle of claim 1 further including a pair of beverage holders disposed on the body member between the pair of passenger cockpits.

* * * * *